United States Patent [19]

Soutsos

[11] Patent Number: 4,604,922

[45] Date of Patent: Aug. 12, 1986

[54] DRILL PIPE TURNING DEVICE

[76] Inventor: Michael D. Soutsos, 5475 Colorado St., Long Beach, Calif. 90814

[21] Appl. No.: 651,162

[22] Filed: Sep. 17, 1984

[51] Int. Cl.[4] ..... B25B 17/00

[52] U.S. Cl. ..... 81/57.17; 81/57.18; 81/57.2

[58] Field of Search ..... 81/57.17–57.19, 81/57.2

[56] References Cited

U.S. PATENT DOCUMENTS

| | | | |
|---|---|---|---|
| 4,099,429 | 7/1978 | Hank | 81/57.2 X |
| 4,212,212 | 7/1980 | Chandler et al. | 81/57.2 X |
| 4,324,157 | 4/1982 | Soutsos | 81/57.17 |
| 4,471,674 | 9/1984 | Doss | 81/57.17 |

*Primary Examiner*—Frederick R. Schmidt
*Assistant Examiner*—Debra S. Meislin
*Attorney, Agent, or Firm*—I. Michael Bak-Boychuk

[57] ABSTRACT

A drill pipe spinner is disclosed including cam surfaces which in the course of tensioning the chain close the jaws of the spinner. The same cam surfaces provide jaw opening moments on release of the chain tension to allow the separation of the spinner from the pipe. These cam surfaces are formed on either side of two tracks in which two slides are fixedly connected to idlers which engage the chain. The idlers, moreover, are mounted for rotation on a transverse bar connected to a hydraulic actuator for tensioning the chain by convolving the chain path.

3 Claims, 8 Drawing Figures

FIG. 1
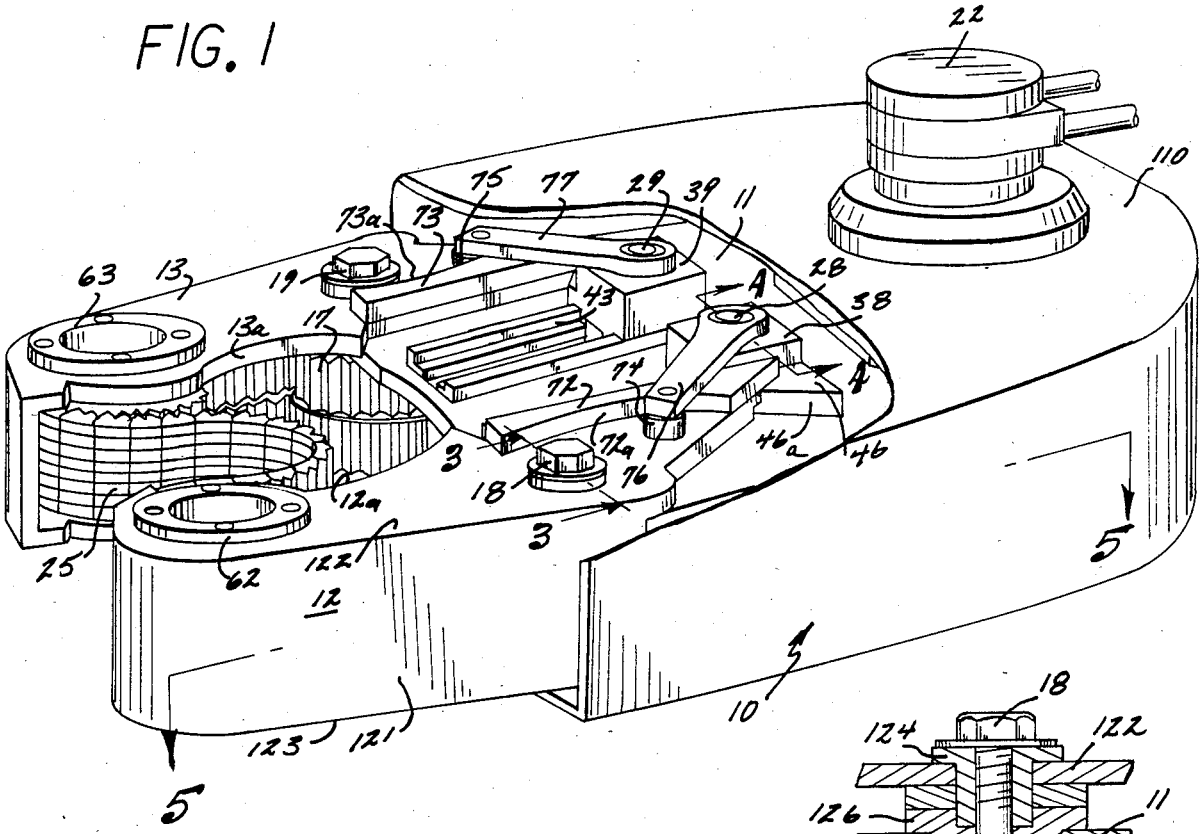
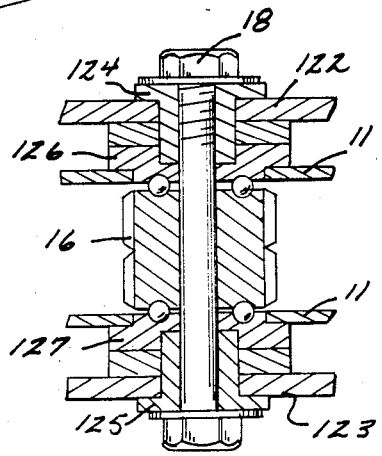
FIG. 3
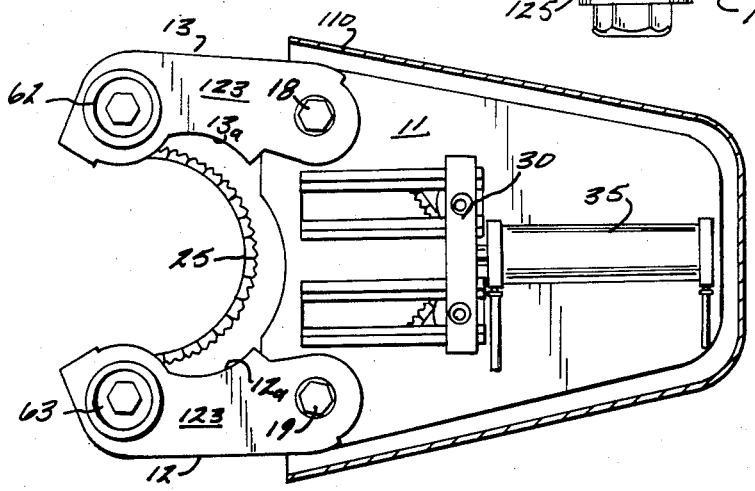
FIG. 2

DRILL PIPE TURNING DEVICE

BACKGROUND OF THE INVENTION

1. Field of the Invention

The present invention relates to drill pipe spinning devices, and particularly to the mechanism for the opening and closure thereof.

2. Description of the Prior Art

The use of spinners to turn segments of a drill pipe in the course of drilling a well has been known in the past. Typically such spinners include a length of leaf chain passed over idlers within a housing and continuing over idlers fixed at the free ends of pivotal arms or jaws conformed to surround the drill pipe. In such configurations, typified by the teachings of U.S. Pat. No. 2,784,626 to Pagett, the chain is tensioned around the pipe and then driven by a motor to turn the pipe segment forming the string.

Now that the deposits of readily available crude are being depleted drilling to deeper depths is more frequently attempted and operating economies therefore form a more significant item in any decision to drill. Thus the time and convenience of the clamping method becomes a substantial cost item in the course of each drilling. One should note that the process of drilling to a deeper area is more dominantly dependent on repetitive operating costs like the costs of mating the pipe segments and any economies realized thereat substantially reduces the total cost of the well.

Accordingly, pipe spinners which offer added convenience to the user are desired in the art and it is one such spinner that is disclosed herein.

SUMMARY OF THE INVENTION

Accordingly, it is the general purpose and object of the present invention to provide a pipe spinner having in the features thereof means for jaw spreading in the course of release.

Other objects of the invention are to provide a pipe spinner which in the course of tensioning the chain tensions the clamping jaws.

Yet additional objects of the invention are to provide a drill pipe spinner which is convenient in use and simple in maintenance.

Briefly, these and other objects are accomplished within the present invention by providing a pipe spinner assembly characterized by two pivotal jaws at one end thereof, each including at its free end an idler for guiding a continuous loop of sheave chain thereabout. At the ends fixed to the spinner body each jaw includes a lever arm incorporating an arcuate cam edge on which a cam follower arm advances. Each of these follower arms are, in turn, fixed to slidable shuttles, each shuttle, in turn, being fixed in a longitudinal sliding track in the body of the spinner. These shuttles then attach to yet another idler guiding the chain thereabout to a sprocket on the output of a motor, the idlers being fixed by their pivots to a transverse brace articulated by a hydraulic actuator to drive the idlers in a forward and a rearward direction thus shortening or expanding the free section of the chain loop between the jaw idlers. Moreover, as each of the shuttles is advanced by the actuator there is a concurrent advancement of a tapered exterior edge on each of the shuttles abutting against the lever arm thus bringing the jaws towards each other. On the return stroke the cam follower arms engaging the cam surfaces spread the jaws, thus maintaining tension in the chain along with the jaw articulation.

In this manner a coherent relationship is developed between the chain and jaw extension to control any looseness in the chain in the course of clamping or removal.

By way of these features a spinner assembly is formed which is conveniently manipulated having removed from the function thereof all concern over jaw spreading and the attendant incidents of binding of loose chains.

BRIEF DESCRIPTION OF THE DRAWINGS

FIG. 1 is a perspective illustration of a drill pipe spinner illustrating the inventive features for manipulating the jaws thereon;

FIG. 2 is a bottom view of the spinner shown in FIG. 1 illustrating the manner of tensioning the chain therein;

FIG. 3 is a sectional view of one idler taken along line 3—3 of FIG. 1;

DESCRIPTION OF THE SPECIFIC EMBODIMENT

Figure 6:
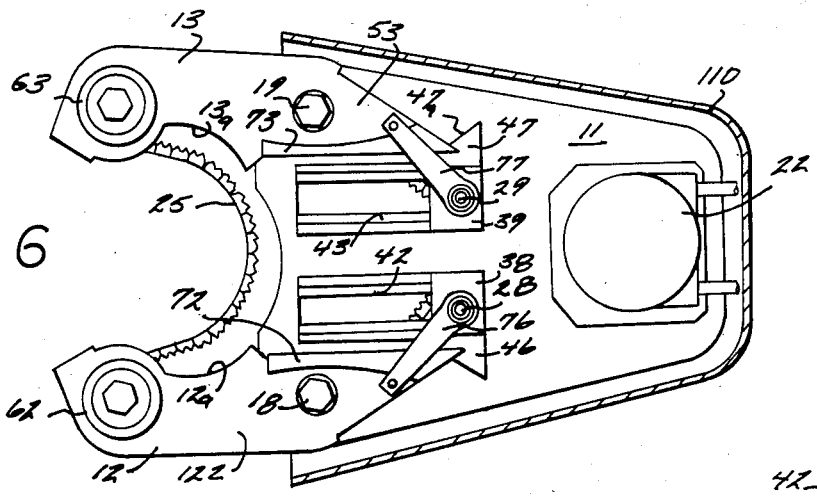
FIG. 6 is yet another top view of the inventive spinner assembly having the jaws thereof spread for receipt of a drill pipe.
Figure 8:
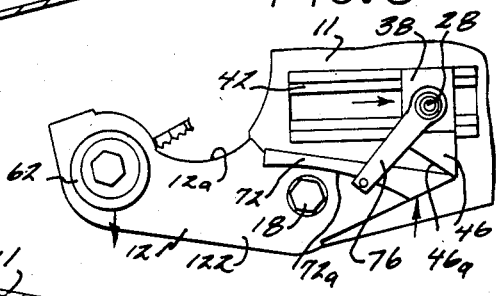
FIG. 8 is a detail of the top view illustrating the cam features described herein.

As shown in FIGS. 1, 2 and 6 the inventive spinner assembly, generally designated by the numeral 10, comprises a main frame 11 of substantially rectangular shape open along one lateral side and having two pivotal arms 12 and 13 extending therefrom. Each of the pivotal arms is generally convolved to define an arcuate interior edge 12*a* and 13*a* for receipt of drill pipe segments therebetween, in a manner described in my prior U.S. Pat. No. 4,324,157 issued Apr. 13, 1982. Moreover, an exterior housing shell 110 is provided enclosing the mechanism described hereinbelow.

Figure 4:
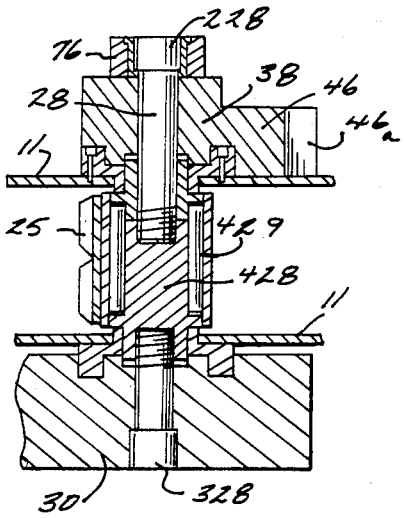
FIG. 4 is yet another sectional view taken along line 4—4 of FIG. 1.
Figure 5:
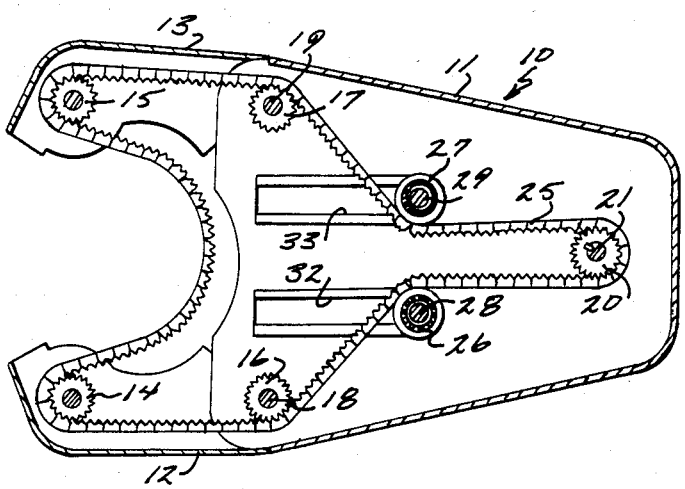
FIG. 5 is a top view of the spinner assembly taken at the section along line 5—5 of FIG. 1.

More specifically, the pivotal arms or jaws 12 and 13 each carry in the free ends thereof a corresponding idler roller 14 and 15 shown in more detail in FIG. 5. In addition the pivotal mount for each arm within the housing 11 is also provided with an idler roller shown as idler rollers 16 and 17 respectively mounted on pivots 18 and 19. Thus pivots 18 and 19, shown by way of bolts passing across the opening in the housing 11, both provide the pivotal support for the arms 12 and 13 and the rolling surface around which the idlers 16 and 17 revolve. Geometrically, the placement of pivots 18 and 19 is arranged at the extremes of the front opening of housing 11, which, at the same time, includes a drive sprocket 20 centrally disposed proximate the rear thereof. Drive sprocket 20, in turn, is keyed to the output shaft 21 of a hydraulic motor 22, sprocket 20 engaging the links of a continuous chain loop 25 which is directed to pass around the exterior of idlers 16, 14, 15 and 17. In the course of this passage chain loop 25 extends through a gap between two rollers 26 and 27 supported on shafts 28 and 29 which, in turn, extend from a transverse bracket 30 illustrated in FIG. 2.

Transverse bracket 30, moreover, connects to a hydraulic actuator 35 on the bottom of the housing and thus is aligned to move together with the rollers in a fore and aft direction. It is to be noted that the spacing between rollers 26 and 27 is substantially less than the spacing between the idlers 16 and 17. Thus, as the rollers are advanced in a direction towards the idlers a more tortuous path is formed for shortening the chain loop. To achieve this travel direction slots are formed in the bottom surface of frame 11 shown by way of two parallel longitudinal slots 32 and 33 respectively receiving the roller mounts 28 and 29. Slots 32 and 33 thus maintain the direction of motion of the rollers with the extension of the actuator 35 to a direction orthogonal to the plane common to idlers 16 and 17.

Figure 7:
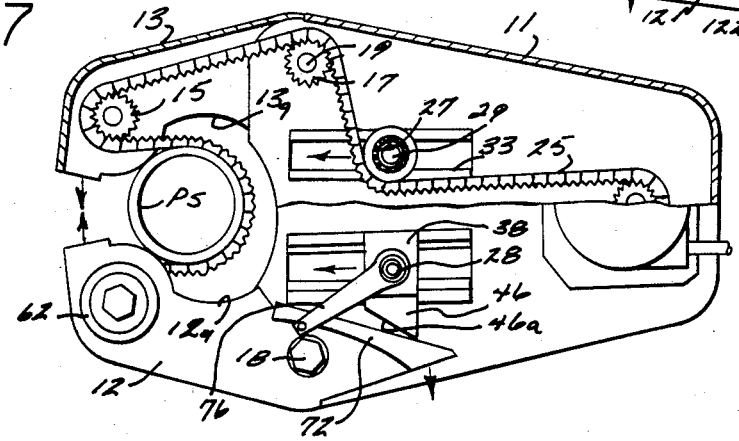
FIG. 7 is yet another top view, in partial section, illustrating the spinner assembly in the course of close around a drill pipe.

In this manner the spacing between rollers 26 and 27 is fixed, as well as the direction of advancement thereof, thus fixing the geometric effect of foreshortening of the chain loop. Moreover, posts 28 and 29 on which the idlers 26 and 27 are mounted terminate in two shuttles 38 and 39, once again, received in grooves 42 and 43 aligned over slots 32 and 33. Accordingly, the expansion of actuator 35 concurrently translates the bottom bracket 30 and the aforementioned shuttles 38 and 39 in a direction towards the plane containing the pivots 18 and 19. Shuttles 38 and 39 each include a wedge-shaped outwardly directed projection 46 and 47 defining outer edges 46*a* and 47*a* which respectively oppose the ends of two cantelevered arms 52 and 53 extending from the jaws 12 and 13. Arms 52 and 53 extend in a direction opposite to the direction of jaws 12 and 13 and thus the separation of the arms will concurrently result in the closure of the jaws. Accordingly, these same actuator expansion that foreshortens the free segment of the chain also drives the jaws towards each other. Once the full extent of the wedging surfaces 46*a* and 47*a* is passed no further jaw motion is effected and the remaining advancement of the actuator will therefore be expended mostly in tightening the chain around the pipe segment grasped within the jaws. Thus the jaws will go through two motion increments, the first directed by the slope of the edge surfaces 46*a* and 47*a* and the second by the radial effects as the shuttles advance along the edges of arms 52 and 53. In the first portion of this closing motion the pipe segment PS as shown in FIG. 7 is grabbed within the confines of the jaw opening and thereafter all subsequent motion is directed at tensioning the chain to transmit driving force from the motor 22.

One should note in accordance with the teachings in my prior U.S. Pat. No. 4,324,157 each of the end idlers 14 and 15 is provided with an enlarged edge plate through which contact is made with the pipe segment. Moreover, each of these end idlers is retained within the arm structure by way of removable bearing plates 62 and 63 thus making repair convenient in the field. Accordingly, large forces can thus be developed in grasping the pipe thus allowing for the large forces necessary in drilling to the substantial depths now required.

The foregoing structure may be further conformed for the additional conveniences in the spinner removal. More specifically, as shown in FIGS. 1, 4, 6, 7 and 8 each of the arms 52 and 53 proximate the bearing edges thereof is provided with overlayed cam segments 72 and 73. These cam segments 72 and 73 at their outer edges define arcuate cam surfaces 72*a* and 73*a* on which two cam following rollers 74 and 75 ride. These cam following rollers, in turn, are fixed to corresponding arms 76 and 77 respectively connected to the pivots 28 and 29 on which the foregoing shuttles 38 and 39 are mounted. Accordingly, on the return stroke of actuator 35 an opening sequence is effected, opening the jaws 12 and 13 in a coherent sequence with chain expansion.

In the foregoing manner the loose chain play heretofore experienced in all prior art devices, is effectively taken out, thus limiting the incidents of chain misalignment and the skipping of teeth. Additionally, both the chain foreshortening stroke and the jaw closure cooperate with each other, thus opposing what has heretofore been a perennial problem in jaw separation while driving forces were applied to the chain.

These particular features as described generally hereinabove are carried out according to the following detail.

Jaws 12 and 13 each comprise thin walled hollow segments defined by a back surface 121 joined to the edges of an upper surface and a lower surface 122 and 123. As shown in FIG. 3 back surface 121 extends from a point adjacent the pivots 18 and 19 to a point beyond the end idlers 14 and 15, bending thereabout, to protect the idlers and the chain from damage. In this form the back surface 121 forms a channel section with the side surfaces 122 and 123 of substantial sectional moment of inertia and thus provides the necessary structure for the large forces entailed in turning drill pipe. Surfaces 122 and 123, moreover, each are provided with inserts 124 and 125 formed to receive the pivot pin 181 (and by example pin 19) which extends into bearing caps 126 and 127 supporting the idler 16 (and 17, by example). By reference to FIG. 4 posts 28 (and by example post 29) are shown as Allen screws 228 and 328 respectively passing through the shuttle 46 and the brace 30 into a bearing carrier 428 on which an exterior sleeve 429 is supported. This structure spans across the walls of frame 11 and provides support for the exterior chain surface.

In this form convenient replacement of the high wear parts is easily carried out in a device which is easily manipulated into position over the drill pipe segment and which in the course of its operation insures the proper control over chain free length to avoid jamming. Thus, a spinner is rendered more convenient in use in an environment which is both harsh and expensive.

Obviously many modifications and changes may be made to the foregoing description without departing from the spirit of the invention. It is therefore intended that the scope of the invention be determined solely on the claims appended hereto.

What is claimed is:

1. In a tool conformed to clamp onto segments of pipe and to advance in rotation said segments, including a frame, two opposed jaw-like arms each of said arms at a first end thereof attached to said frame by a pivotal mount and each arm including rolling means at a free second end thereof, a chain loop, a motor attached to said frame for advancing said chain loop, said motor including a drive sprocket thereon, said chain loop extending around and in engagement with the drive sprocket, the pivotal mounts, and the rolling means;

said arms each including levers radially extending from said pivoted mounts and projecting over said frame;

a pair of shuttles slidably mounted on said frame and having camming means to abut against said levers to pivotally articulate said arms around said pivotal mounts in the course of the translation of said shuttles;

a pair of shuttle idles supported for rotation on said shuttles and aligned to engage the exterior of said chain loop; and actuating means operatively connected for translating said shuttles.

2. Apparauts according to claim 1 wherein:

said levers each include a cam edge; and said shuttles each include a cam follower opposing a corresponding one of said cam edges.

3. Apparatus according to claim 2 wherein:

said arms include arm idlers at said pivotal mounts aligned to engage said chain loop; and said levers are aligned to pivotally articulate said arms about said pivotal mounts concurrent with the translation of said shuttles.

* * * * *